United States Patent [19]

Wallace

[11] Patent Number: 4,620,581

[45] Date of Patent: Nov. 4, 1986

[54] INSULATION AND SECURITY SHUTTER

[76] Inventor: Howard K. Wallace, Rte. 2, Box 69B, Melrose, Fla. 32666

[21] Appl. No.: 534,420

[22] Filed: Sep. 21, 1983

[51] Int. Cl.[4] ..... E06B 9/02; E05D 3/02; E05D 15/26

[52] U.S. Cl. ..... 160/187; 160/213; 160/229 R

[58] Field of Search ..... 160/213, 40, 232, 117, 160/118, 186, 187, 229 R; 52/309.9

[56] References Cited

U.S. PATENT DOCUMENTS

| | | | |
|---|---|---|---|
| 1,089,449 | 3/1914 | Walsh | 160/213 |
| 1,923,604 | 8/1933 | Woodruff | 160/213 |
| 2,907,383 | 10/1959 | Kloote et al. | 160/232 |
| 4,363,351 | 12/1982 | Eriksen | 160/187 |
| 4,436,135 | 3/1984 | Ytter | 160/232 |

FOREIGN PATENT DOCUMENTS

| | | | |
|---|---|---|---|
| 693644 | 9/1930 | France | 160/211 |

*Primary Examiner*—Ramon S. Britts

*Assistant Examiner*—Cherney S. Lieberman

*Attorney, Agent, or Firm*—Russell, Georges, Breneman Hellwege & Yee

[57] ABSTRACT

An air tight shutter is provided having a set of pre-made bifold doors in conjunction with a frame wherein the shutters are manufactured to have tight tongue-in-groove reception area not only with respect to the bifold doors but also with respect to the bifold doors and frame. A burglar proof latch mechanism is provided such that a ball crank is turned by means of a handle thereby withdrawing elongated rod-like members from the frame section which then permits the bifold doors to open, or in the alternative, the ball crank is turned in the opposite direction causing the elongated members to penetrate an aperture in the frame and thereby lock the shutters in place. An assembly method for producing the shutter is also disclosed, along with the machinery particularly adapted for said assembly method. The machinery disclosed achieves the close tolerance required in a assemblying of the shutter.

1 Claim, 29 Drawing Figures

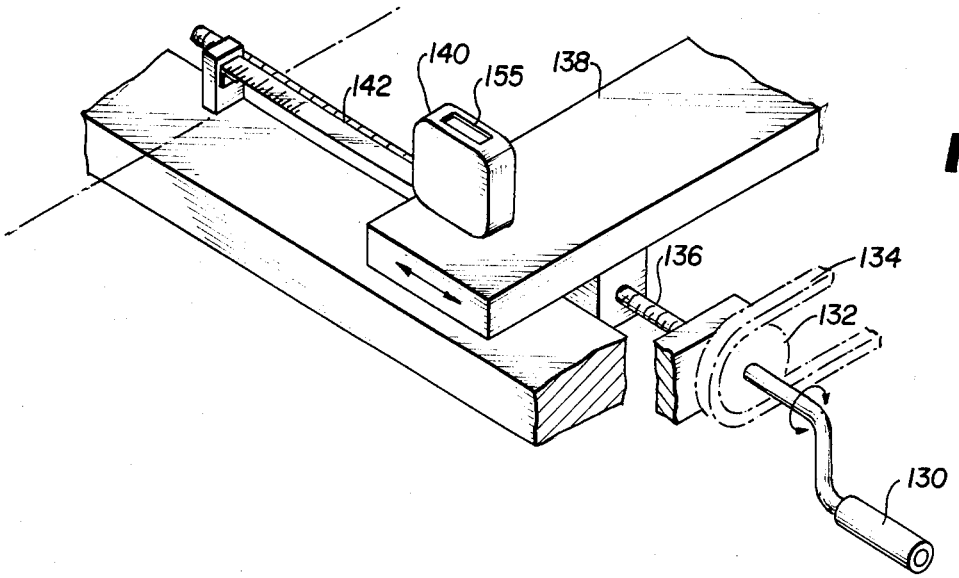
FIG. 14
FIG. 15
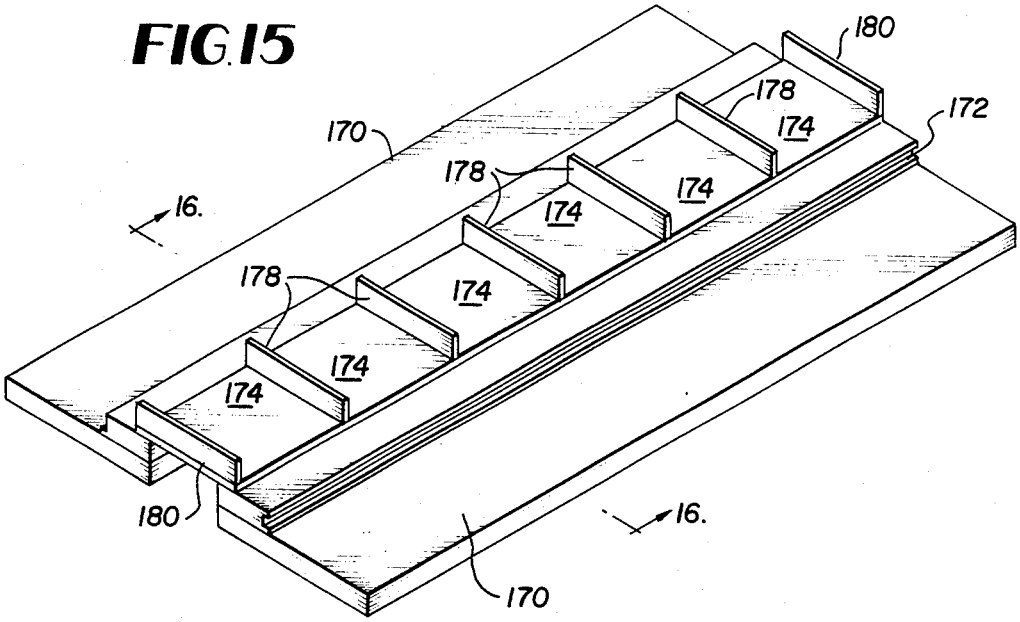
FIG. 16
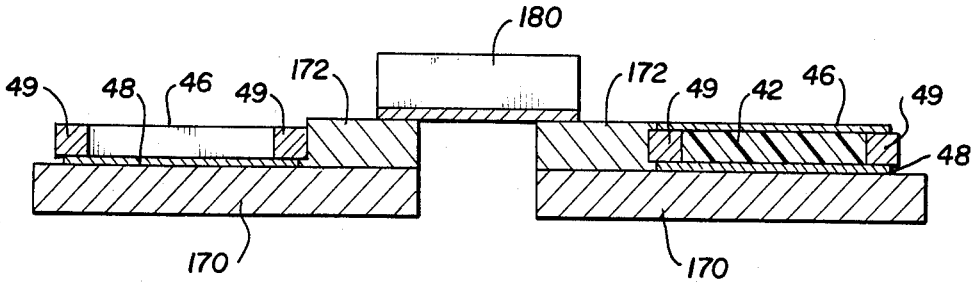

FIG. 20
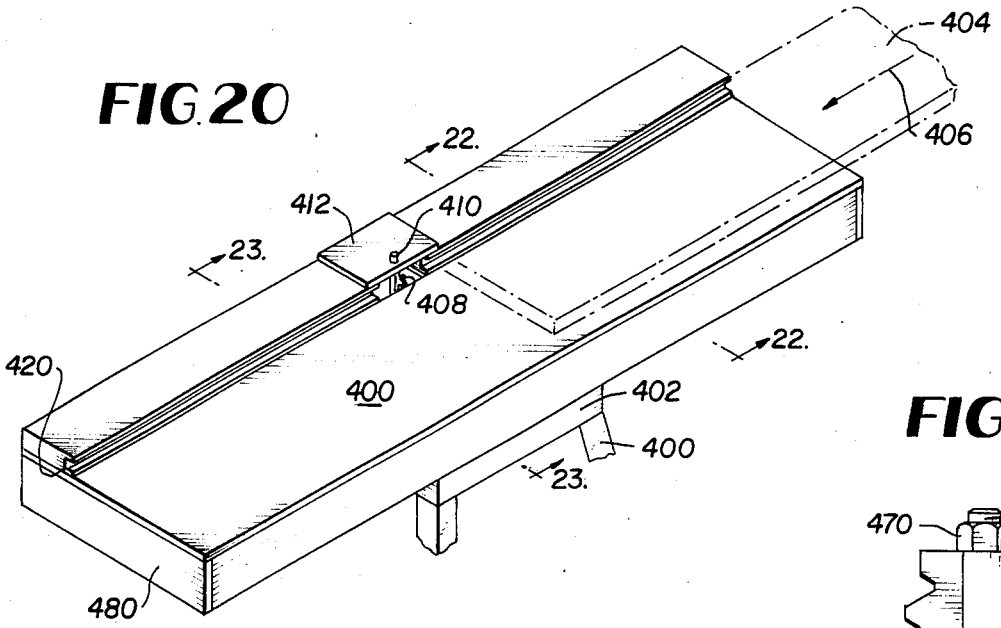
FIG. 21
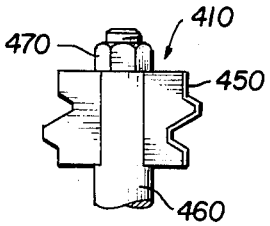
FIG. 22
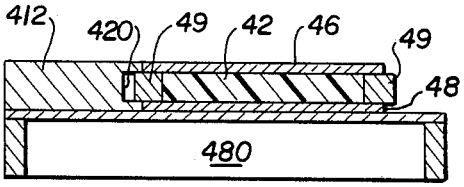
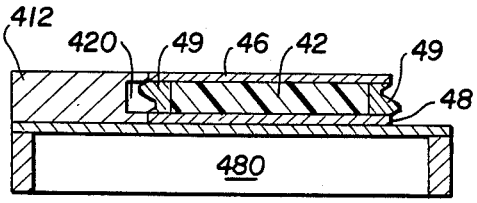
FIG. 23
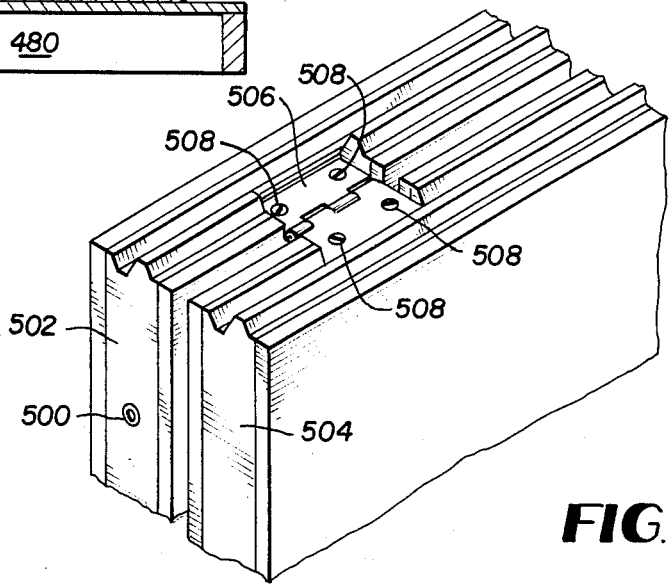
FIG. 24

INSULATION AND SECURITY SHUTTER

FIELD OF THE INVENTION

The apparatus of this invention is constructed to modify an opening in a building to provide additional insulation qualities and to upgrade the security of the building against an unwanted intrusion. As energy costs for heating and cooling have increased greatly in recent years, the commercial viability of a pre-assembled tight-fitting shutter for windows and doors has been greatly enhanced. It simply is not reasonable in most cases to construct a permanent fixture to increase the insulating abilities of a wall of a building where a window is situated for passage of light to the interior of the structure. If a folding or easily removable structure can be formulated for opening windows then, at the whim or desire of the building occupant, the shutters may be opened to allow radiant heat to pass into the structure or closed to keep heat in. Also, when it is desirable to attain privacy, whether at night or in the day, it is advantageous to have an easy means for blocking the view path of a window from a viewing reference point exterior from the building.

Any time an opening in a wall is made for a window or door, the likelihood of an unwanted intrusion increases. The burglary rate has consistently risen in recent times such that a chance of intrusion in a home is approximately a staggering 1 in 7 chance on an annual basis. It would be most desirable to provide a fail-safe security system which could be placed over requisite doors and windows at times when the chances of an unwanted intrusion are likely, i.e. when the occupants of the home are sleeping or are away from the premises. Any such structure which has a lock mechanism activated from the outside can easily be rendered ineffective by a crimial of even modicum skill. A deadbolt locking mechanism is advantageous but only so if the deadbolt activating mechanism is situated at a location not accessible from the outside of the building. With the deadbolt locking mechanism situated only on the interior surface of the hereinafter defined panels, there is an increased ease in opening at any desired time.

Thus, the field of this invention can be bifurcated into two mutually exclusive areas of (1.) increased occupant security and (2.) decrease in the cost of heating and cooling a residence or business.

BACKGROUND OF THE PRIOR ART

Candor compels a recognition of known prior art.

The general applicable areas of classification of this invention would appear to be Class 52 and Class 160. The following is a recitation in chronological order, without regard to relative pertinency, of references which are concerned with related subject matter.

In 1930 a U.S. Pat. No. 1,746,983 issued to Barr relating to a bifold metal window having a simple means for locking such that they (the bifold doors) could not be opened from the outside. The lock system includes Cremorne bolts having two slide pieces both of which connect to a central handle. When the handle is turned or pulled, a force will be exerted on the slide members and they will respectively recess from their keepers located juxtaposed to the window frame at the upper and lower portions of the same. An automatic locking means centering around a pair of snap bolts is also disclosed. Some 34 years later, a U.S. Pat. No. 3,144,077, issued to Dickinson et al concerning folding doors which control the motion of the doors as they are opened and closed. A moveable guiding track is positioned directly above the bifold doors such that both members of the doors can be opened completely regardless of the position of the wall juxtaposed thereto.

In 1966 U.S. Pat. No. 3,246,684 issued to Rudnick for a hinge structure of the non-pinching type. In this mechanism a relatively narrow elongated rectangular intermediate panel is placed on the connection of the two bifold doors. Piano-type hinges are then attached to this elongated narrow piece and to each of the respective doors. Therefore, as they are opened and closed there is no uncovered aperture along the entire length of the bifold doors to pinch fingers. A pre-assembled, pre-hung door unit is described in Winnan, U.S. Pat. No. 3,314,534. Much care is taken to provide a shippable item secured against inadvertent opening during shipment. Normally, the structure is held in place by removable means such as tape or an adhesive strip to prevent an inadvertent opening of the doors. Bifold doors are aligned by means of the apparatus of Lawrence, Jr. U.S. Pat. No. 3,351,973 wherein identically constructed aligner brackets are situated to mesh perfectly when the doors are in the closed position and thereby insure adequate alignment. The mounting means for the brackets are adjustable to a small degree so that a fine-tune alignment can be accomplished during their securement with the doors.

A prefinished frame with plastic decorator panels is described in Weaver, U.S. Pat. No. 3,440,786, issued in 1969, wherein prefinished stiles and prefinished rails enclose a central panel via a receiving groove juxtaposed to one long inside face. The rails are thinner than the stiles and the stiles are elongated and have flanges flanking the central groove to define the rail and receiving channel on the long inside face of the stile. A bifold door system described in Thun et al, U.S. Pat. No. 3,811,486 (1974) concerns a pair of door panels hinged together with a vertical track-way superimposed thereover so that the bifold doors may be opened by sliding a circular item through or along the track means. The doors are respectively pivoted at a point juxtaposed to the frame. The hinges connecting the bifold doors permit the panels to be opened to substantially face-to-face inner engagement and to bias the panels in a closed position substantially flush with the door frame. A retention means is also used to hold the doors in an open position until a predetermined force is applied, at which time a torsion spring is released, which allows the bifold panels to automatically return to the closed position. A male projection is utilized in conjunct association with a female socket (receiving) member to properly align and retain folding doors in Smith, U.S. Pat. No. 3,907,021 (1975). In this system the male member comprises a unified molding of thermal plastic material, usually of cylindrical shape, having a length substantially equal that of the mounting socket; thus, as the male member is inserted into the female member, alignment must be attained and the bifold doors only can be opened by removing the male member axially from the female socket, which requires at least a slight force.

In 1978 U.S. Pat. No. 4,072,548 issued to Gerson et al for a rectangular wood frame panel door which is subdivided to define two or three smaller central openings. These openings are filled with a reinforced polyurethane panel and a thin plywood panel is laminated to the backside of the door. Thus, a door which is strong and weatherproof is constructed from a solid wood frame and has the feel of a hand-curved hardwood frame. Another insulated molded prefabricated panel is discussed in Clark et al, U.S. Pat. No. 4,223,500 (1980), a thermal gap is filled with insulation material to prevent heat loss or gain from one side of the panel to another. A cam lock is provided wherein a locking level attached to a bracket is pivoted about a horizontal axis with a tool such as an allen wrench to engage a second panel having a locking bolt recessed therein. This provides a continuous set of insulated panels. Another plastic core door is described in Palmer, U.S. Pat. No. 4,265,067 (1981), the disclosure of which encompasses a relatively cogent compendium of decorative panels having foam sandwiched between two sheets of planar material. In this system, the outer skin is comprised of a pleasant looking wood or cellulose material and the core comprises a foamed material having heat insulation capabilities. Finally, in Cowden et al, U.S. Pat. No. 4,272,934 (1981), a panel structure for use in blocking glass panes against the passage of heat and cold is disclosed. These panels, having heat insulation abilities, are held in place by means of a magnet on either side of the window. Thus, the window pane is completely surrounded by sets of insulating material.

Heretofore, the prior art has failed to describe or render attainable an insertable pre-hung bifold door having insulating material throughout, which in the closed position is maintained in such a tight fit that passage of air through any elongated apertures is negligible. This latter quality is derived by a precise tongue-in-groove (tongue and groove) relationship of not only the bifold doors themselves but also the bifold doors with the door frame. In addition, the prior art has failed to take cognizance of a security shutter having opening means only on the inside of the shutter, wherein by the mere turn of a knob or a handle, two elongated rod-like members are withdrawn from apertures within the frame surrounding the bifold doors permitting opening of the same, or in the alternative, when the knob or handle is turned in the opposite direction, the elongated members become inserted into an aperture in the door frame. This prevents either pushing open of the bifold doors from the outside or opening of the bifold doors from the inside without the knob or handle being turned in the proper direction.

SUMMARY OF THE INVENTION

To summarize this invention in its most cogent form, a window or door insert is provided having heat insulation capabilities and having anti-burglary locking, closing and opening means. As shown in FIG. 1 of the drawings, it is contemplated that these shutters may be utilized in a door frame. On the other hand, it is also contemplated that they can be used in any wall opening such as a window. It does not seem to matter whether the window is the regular sash-type window, a fold-out window or a dormer-type window. The shutter insert is placed on the inside of the window and is secured to the frame by means of a conventional fastening means.

The construction of this pre-assembled bifold door or window insert is such that when in the closed position, as shown in FIG. 2 of the drawings, an air tight seal is achieved to nearly completely eliminate any elongated vertical apertures which pass cold or warm air therethrough. In the closed position, the preassembled shutter insert acts as an additional wall structure to form a completely planar surface across the window well as viewed from inside the structure. The tightness of the fit of the insert shutter is resultant from the method of constructing the same by means of tools or apparatus set forth in FIGS. 12 through 29 of the drawings.

OBJECTS AND EMBODIMENTS

One object of this invention is to provide a preassembled door or window insert which has heat insulating abilities superior to those previously disclosed in the prior art.

Another object of this invention is to provide such a shutter as before mentioned and having security features so that the same may not be opened from the exterior of the premises.

Another object of this invention is to provide a unique, beautiful and practical insulating shutter that may be installed with or without drapes and which is hand-crafted of the finest materials with concealed hinges and double tongue-in-groove joints such that, in the closed position, one viewing the structure from the inside of the home or business would be unaware that a door or window is behind the applicable shutter.

Another object of this invention is to provide a shutter as aforementioned with double tongue-in-groove construction to give a virtual airtight seal and which can be made in any custom size with a deadbolt locking system for excellent security.

Another object of this invention is to provide a practical and beautiful shutter to be inserted into a window or door well which contains throughout a styrofoam core to aid in insulating.

Another object of this invention is to provide a shutter as aforementioned with a precut window or set of windows in the shutter to emit light therethrough and to permit viewing from either the outside in or the inside out.

Another object of this invention is to provide an interior shutter with frosted or one-way windows wherein a person situated on the exterior of the premises cannot view anything occurring within the premises.

One aspect of this invention resides in a tight fitting openable-closeable shutter which comprises a frame having a top and bottom elongated member of substantially equal length and two side elongated frame members interconnecting said top and bottom elongated members, said side members of substantial equal length and said top and bottom members each having at least two apertures therein; a set of bifold doors each having four surfaces divided between two front planar surfaces and two back planar surfaces, each respective front-back planar surface having substantially equal dimensions; two elongated top and two elongated bottom members respectively in communication with said front and back two planar surfaces; four elongated side connecting members each of which is in contact with said respective elongated top and said respective elongated bottom members and in contact with said front and back planar surfaces, wherein said side members, planar surfaces and elongated top and bottom members form two hollow panels which comprise one set of bifold doors; a hinge means connecting said hollow panels such when said hinge means is closed each bifold door comprises a continuous panel with a lengthwise aperture bifurcating said continuous panel and when said hinge is open said bifold doors comprise two separate but interconnecting hollow panels; insulating material situated within said hollow sections of each set of said bifold doors; a closure means for each set of doors comprising two elongated rod-like members receptive at one extreme for penetration into said apertures in said elongated top and bottom frame members and connecting at the other extreme to movement means, wherein when said movement means is actuated in one direction said rod-like members concomitantly retreat from said apertures in said elongated top and bottom frame members and when said movement means is actuated in the opposite direction said rod-like members concomitantly penetrate into said apertures in said elongated top and bottom frame members; and a tongue and groove configuration on the two elongated side members at the point of contact of the bifold doors when the same are situated in the closed position.

Yet another specific embodiment of this invention resides in an insulation shutter constructed to retrofit an existent window frame which comprises a frame having an upper frame member and a lower frame member, each having two apertures recessed therein, and both in interconnection with respective side frame members by a fastening means; said frame tightly enclosing two bifold doors each comprising two hinged hollow panels for placement of insulation, said panels being hinged to one another and to said respective side frame members, wherein the elongated first portion of one of said hollow panels, juxtaposed in relation to the other elongated portion of the second panel has a tongue extending the entire length or nearly the entire length of said first portion, for reception into a groove placed and extending the entire length or nearly the entire length of said second portion and wherein said bifold doors possess a tongue-in-groove relationship along the length of the panels when they are closed and juxtaposed to one another.

The following drawings exemplify various apparatus which can be employed to construct the precise insulated panels.

Figure 12:
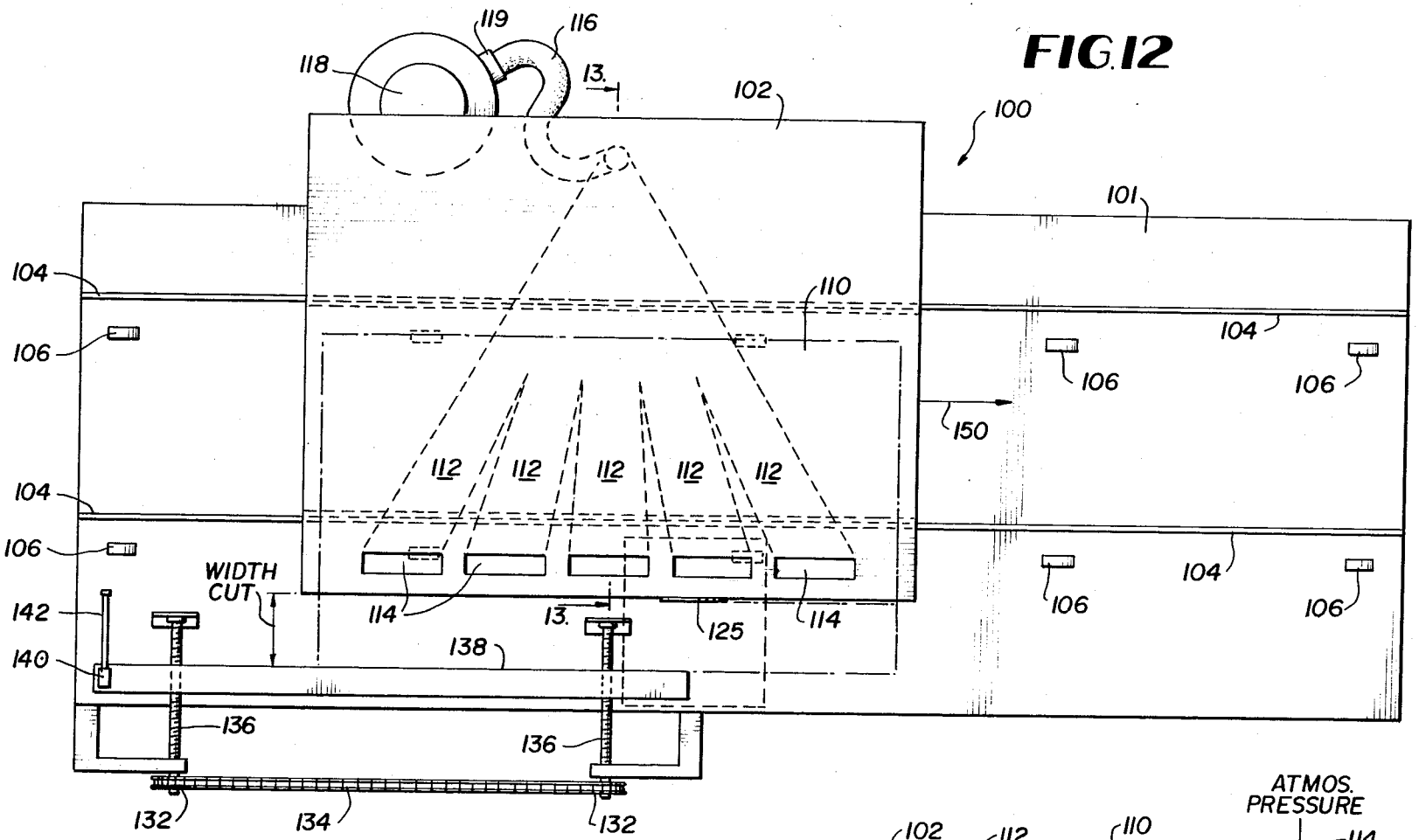

FIG. 12 is a plan view of a vacuum-saw used to perform exact cuts of the wood panels for the inside and outside of the doors.

Figure 13:
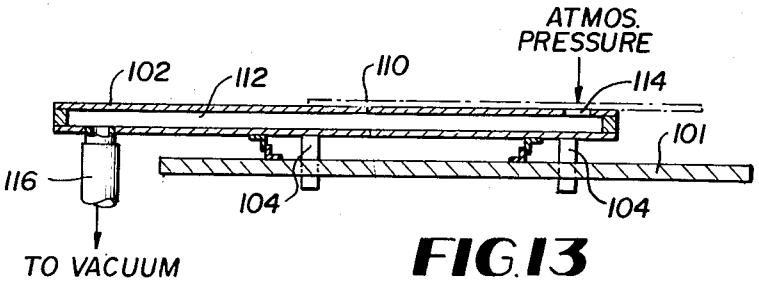

FIG. 13 is a sectional view taken along line 13—13 of FIG. 12.

FIG. 14 is a perspective view of the corner of the vacuum-saw of FIG. 12 showing a fence means for obtaining an exact plan cut.

Figure 7:
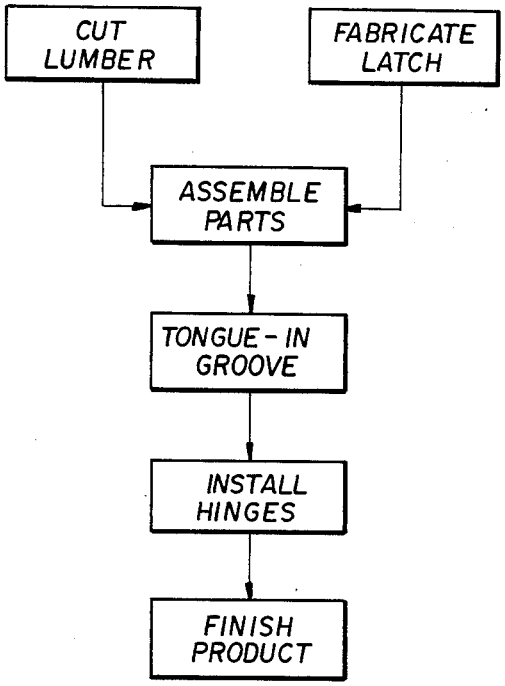
FIG. 7 is a block diagram of the fabrication method used to construct the doors.

FIG. 15 is an assembly jig used to assemble the parts in the third block of FIG. 7.

FIG. 16 is a cross-sectional view of FIG. 15 taken along lines 16—16.

Figure 17:
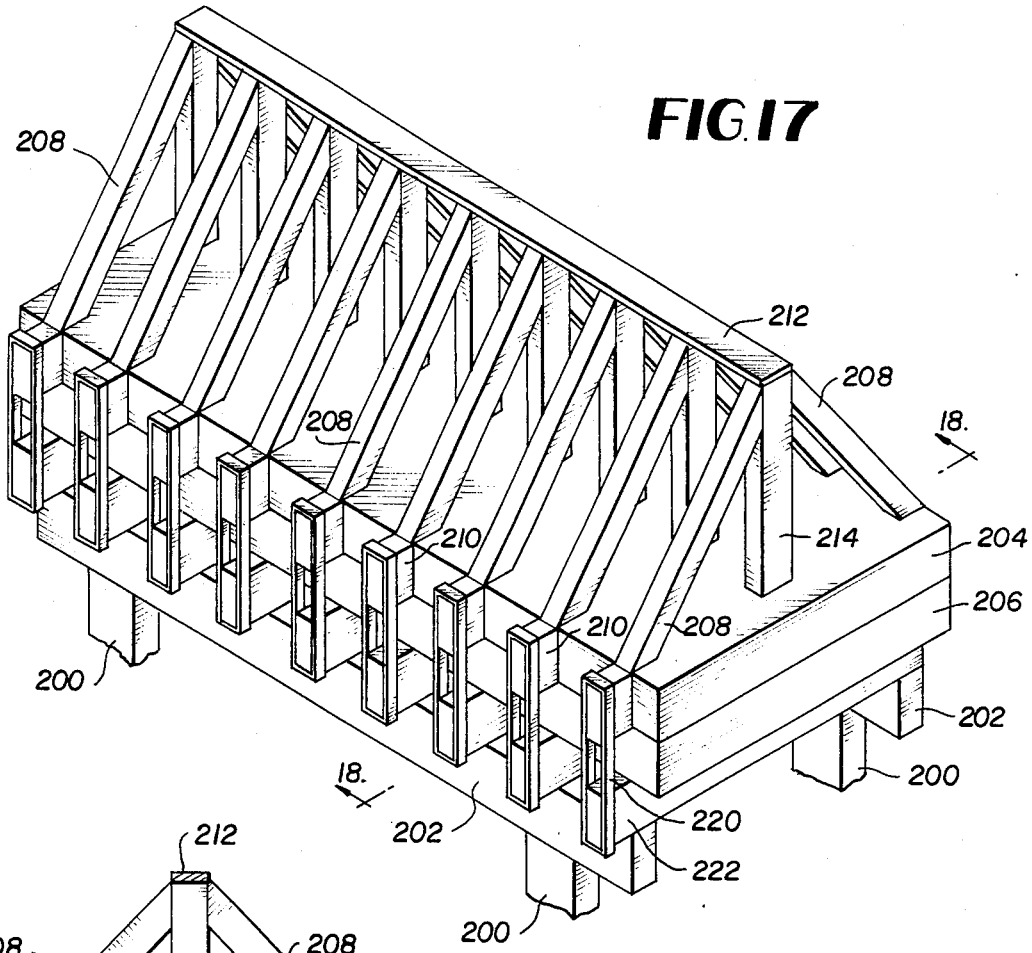

FIG. 17 is a perspective view of the pneumatic press used to assemble the parts.

Figure 18:
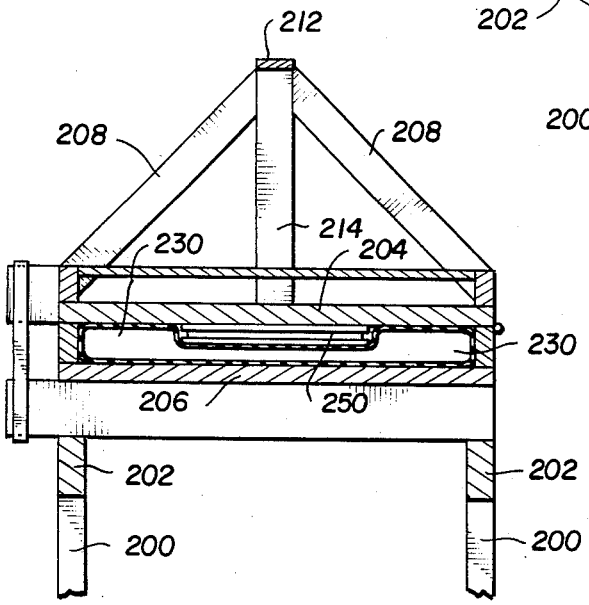

FIG. 18 is a cross section view of the press of FIG. 17 taken along lines 18—18.

Figure 19:
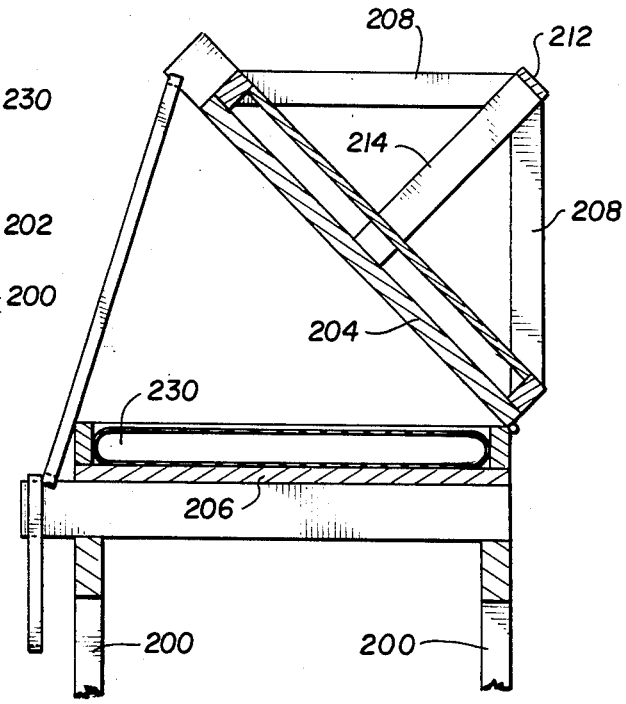

FIG. 19 is an open cross-section view of the press of FIG. 17.

FIG. 20 is an elevation view of the router machine useful in forming exact tongue-in-groove cut in the sides of the panels.

FIG. 21 is an enlargement of the router blade contained within the router machine.

FIG. 22 is a side view of the panel on the router machine of FIG. 20 prior to being routed (having the tongue-in groove).

FIG. 23 is a side view of the panel on the router machine of FIG. 20 after passage through the router blade of FIG. 21.

FIG. 24 is a fragmented perspective view of two panels placed together.

Figure 25:
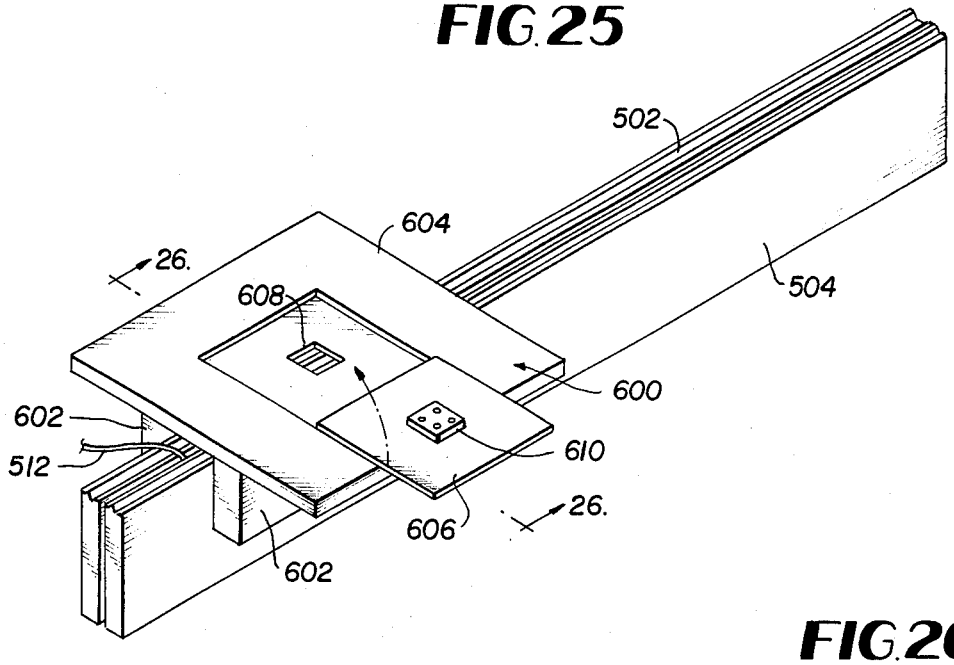

FIG. 25 is a top elevation view of a handling jig use to place apertures in exact locations in the sides of the panels.

Figure 26:
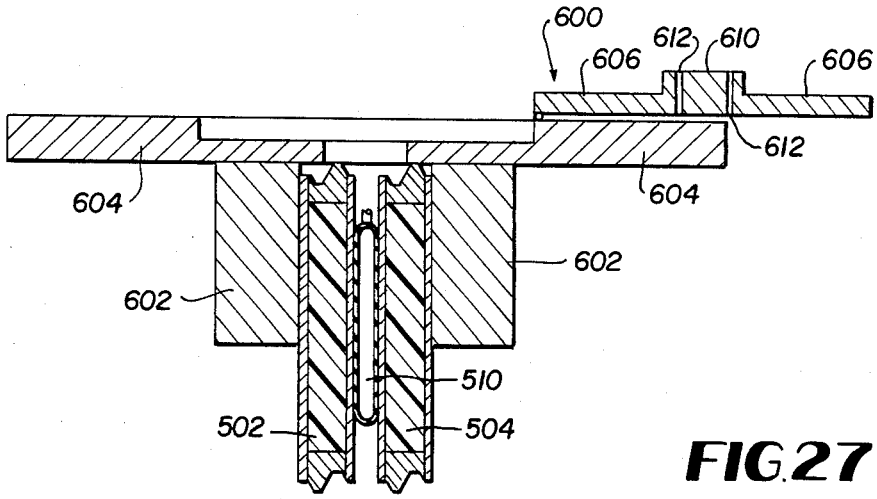

FIG. 26 is a side view of a handling jig where the open space for the hinges is yet to be milled.

Figure 27:
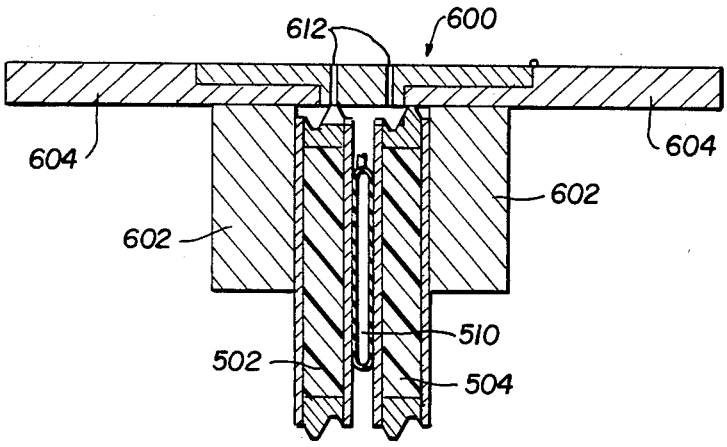

FIG. 27 is a side view of the handling jig of FIG. 26 where drill holes are placed in an exact position in the milled panels.

Figure 28:
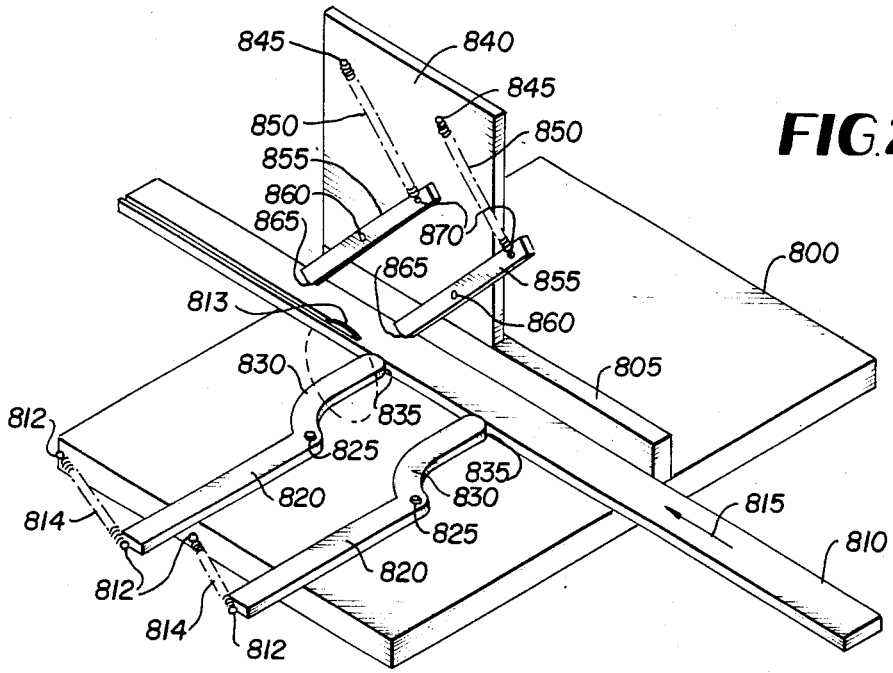

FIG. 28 is a side view of a safety feature of the vacuum saw.

Figure 29:
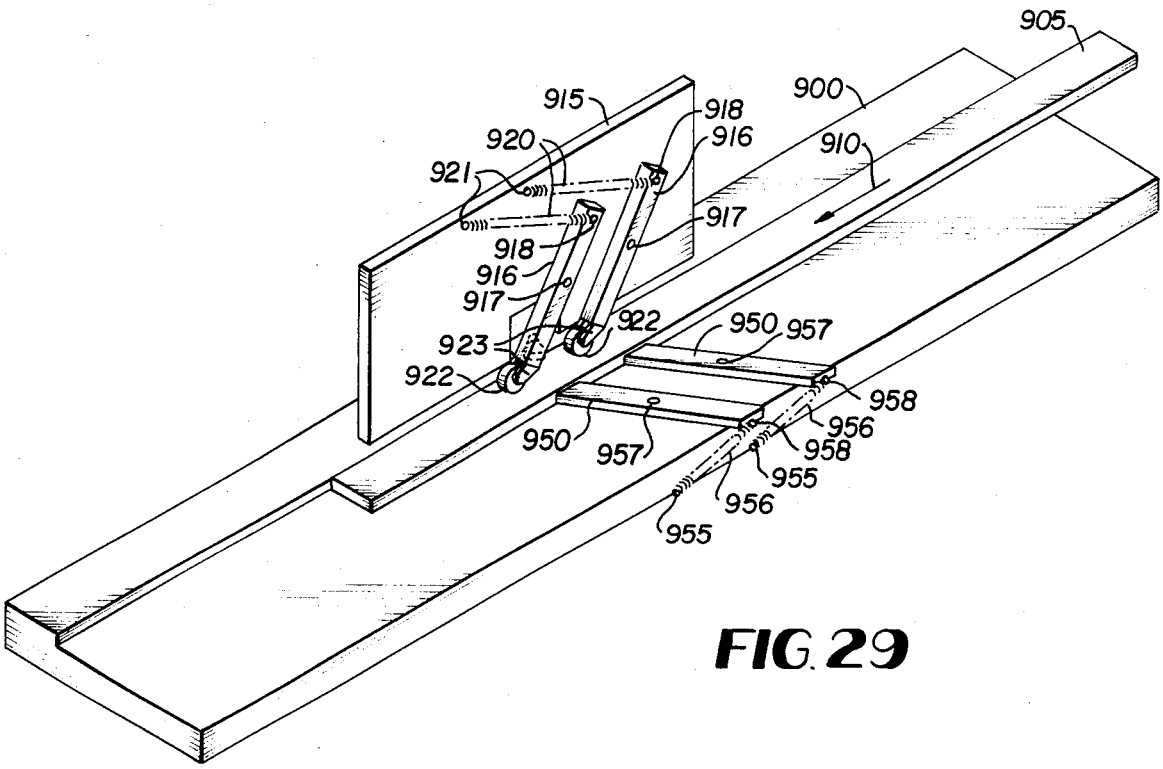

FIG. 29 is a side view of a safety feature of the router jig.

DETAILED DESCRIPTION OF THE DRAWINGS

FIGS. 1 through 11 relate to the shutter per se and the general method of formulating same. FIGS. 12 through 29 relate to the equipment necessary to teach how to make these shutters having a relative air tight seal. The description of the drawings will thus be bifurcated in regard to these two sets of drawings. (FIGS. 1–11 vis-a-vis FIGS. 12–29).

Figure 1:
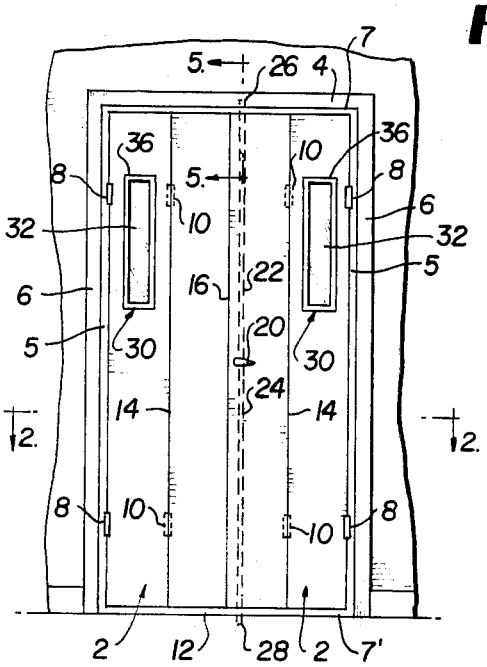
FIG. 1 is a front elevational view of the insulated doors in place in a door frame.

FIG. 1 is a front elevational view of insulated doors placed within a conventional door frame 6. The frame of the bifold doors has two side pieces 5, a top piece 7 and a bottom piece 7. It is contemplated that these door-window shutters will have varying dimensions as frame 6 requires; thus, the vertical members 5 and the horizontal members 7, 7' will be formulated after the inside dimensions of the door and window frame are ascertained. Hinges 8 are utilized to connect the bifold doors 2 to the upright vertical members 5. As shown later, these hinges are recessed in a tongue-in-groove portion of the shutter and the respective upright frame member. It is important to note that these hinges, as well as hinges 10 holding together the bifold doors, must be placed in an exact location within approximately 1/16 of an inch to provide for a smooth, tight fit upon closing. Upright and horizontal members 5, 7' and 7 are provided with multiple apertures for passage of a convenient fastening means therethrough to secure the shutter to the door jam 6, 4, and 12. Any well-known fastening means can be involved or if desired the shutter may be nailed to the frame 6, 4 and 12 with an acceptable 6, 8, 12, 20 etc. penny nail. Upright members 5 may or may not be mitered to meet members 7, 7'. Fastening devices are passed through the upright members 5 into horizontal members 7',7 to form a sturdy rectangle or square perimeter. Three elongated apertures are present in the door. Two such elongated apertures 14 bifurcate each panel of the bifold doors. The third elongated aperture 16 is disposed to traverse from top to bottom between the respective bifold doors. Thus, when the doors are placed in the open position, elongated apertures at 14 depend on hinges 10 to provide an opening and thereby create a void space at 16. And as the doors are opened the void space enlarges; as the doors are closed the void space closes until the tongue-in-groove fit substantially obliterates elongated aperture 16 altogether.

Unlike some of the prior art references above noted, (See Dickinson et al, Rudnick, Winnan or Lawrence, Jr.) it is not absolutely necessary nor even preferred that these bifold doors possess an elongated surmounted open-closed track in the top horizontal member 7. In this manner the doors are not made to pivot from the top and bottom members 7, 7' respectively, but open in accordian fashion by means of hinges 8 connected to upright members 5 until they are fully open.

A handle 20 is provided to actuate the opening means 50 shown in Figure. Two elongated rods 22, which may be made of either very hard wire or a rod-like material traverse the entire length or height of the doors. A recessed area or aperture 26 and 28 appear in horizontal frame members 7, 7'. Consequently, when handle 20 is turned (as later described in re FIG. 6), the elongated members are removed or extracted from the apertures respectively, 22 from 26 and 24 from 28, thereby permitting the doors to freely open. These doors may have a single latch as shown in FIG. 1 or the latch may be unique to each set of bifold doors. It is also contemplated that one or more windows 30 may be placed in the panels of the bifold doors. Those windows can be constructed of either frosted glass, plastic or security proof plexiglass shown as 32. The frame of the window is denoted as 36.

Figure 4:
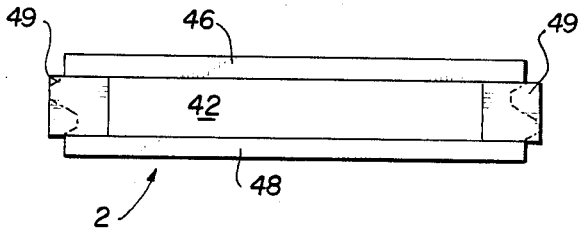
FIG. 4 is a section elevational view prior to milling.
Figure 2:
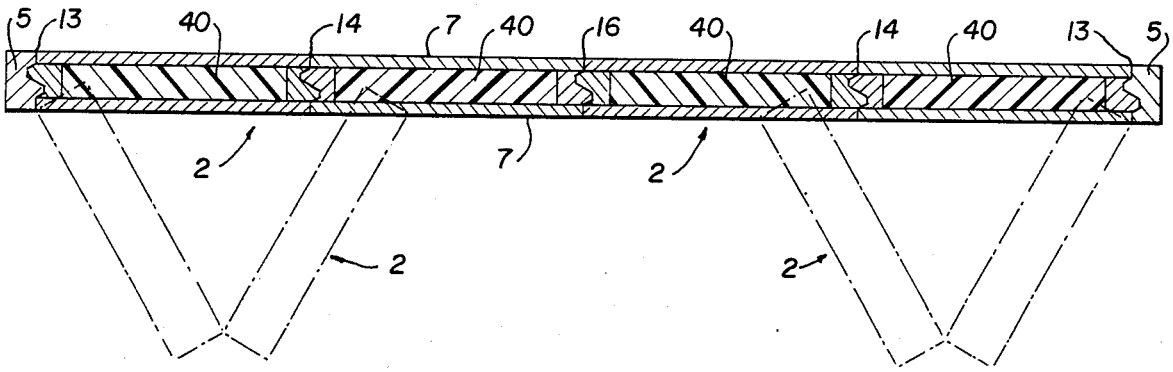
FIG. 2 is a top elevational view taken along the line of 2—2 with the dotted lines denoting a partially open position.
Figure 3:
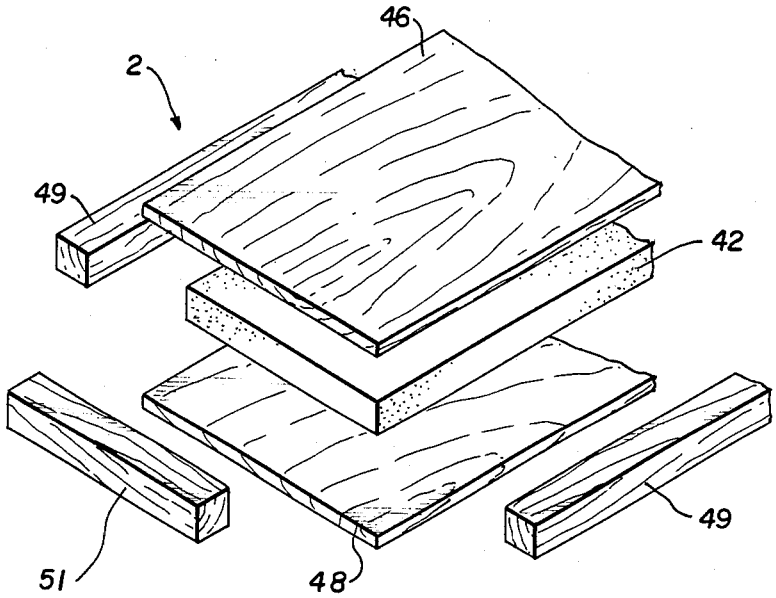
FIG. 3 is an exploded view of the multiple components of the insulated doors.

FIG. 2 is a top elevational view taken along the line of 2—2 of FIG. 1, the dotted line denoting the bifold doors in the open position. Not seen in FIG. 1 is the tongue-in-groove fit along elongated apertures 14, 14 and 16 in addition to the tongue-in-groove milling formed at 13 (also not shown in FIG. 1) of the door with upright frame member 5. It can be seen that there is not a necessity to have a top surmounted opening track although the same is not excluded from this invention. Open spaces 40, as shown hereinafter, are filled with insulating material throughout. FIG. 3 is an exploded view of the multiple components of the insulated doors. The insulation is usually styrofoam denoted as 42 although any feasible insulating material can be used such as a polyurethane foam, styrofoam, fiberglass, etc. As shown in FIGS. 3 and 4, each section of bifold door 2 is comprised of two elongated panels 46 and 48. Four of these panels, two each of which are hinged to each other, comprise one bifold door structure. Side pieces 49 which are later milled as shown in the dotted line of FIG. 4 encompass the insulating material 42 in interconnection with top planar surface 46 and bottom planar surface 48. There is also described a top containment piece 51 in addition to a bottom containment piece not shown in FIGS. 3 or 4. Thus, the styrofoam or other insulating material is held completely between decorative pieces of wood on the top, sides, bottom, front and back. The dotted line in FIG. 4 indicates the line of milling to be undertaken in side pieces 49.

Figure 6:
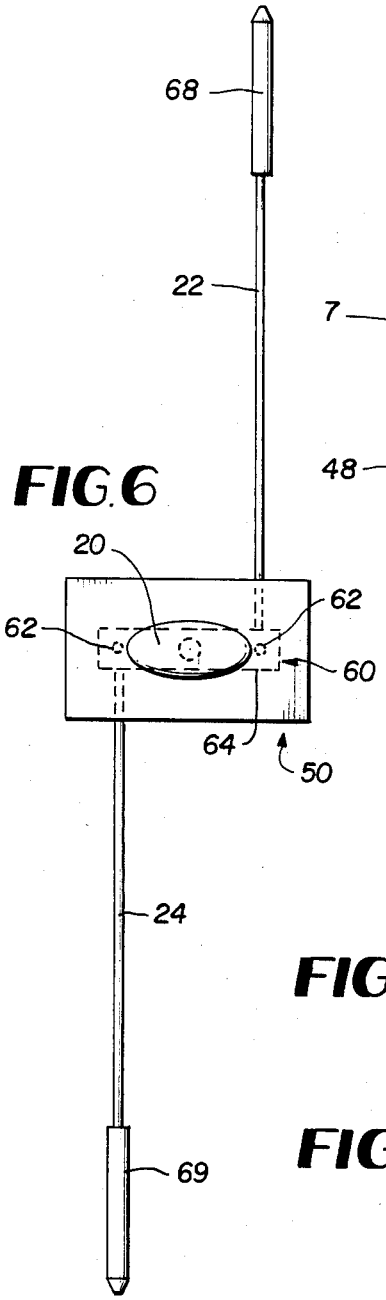
FIG. 6 is an elevation of the latch mechanism extracted from the door for viewing convenience.
Figure 5:
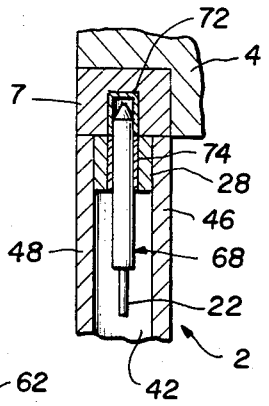
FIG. 5 is a cross section view taken along 5—5 of FIG. 1.

FIG. 6 is an elevation of the latch mechanism extracted from the door for viewing convenience. It is denoted as item 50. A knob or handle 20 is provided in communication with elongated rods denoted as 22 and 24 (See also FIG. 1). The interconnection of the knob or handle with the elongated rods is made by ball crank 60. The connection of the rods with the ball crank is made by a rivet or galvenized pivot 62 such that when ball crank plate 64 is turned responsive to the turn of handle 20, elongated rods 22 and 24 follow to either shorten rods 22 and 24 in relation to apertures 26 and 28 or lengthen the same by turning the handle in the opposite direction of rotation. This results in a relative increase in length of top and bottom male members 68 and 69. FIG. 5 shows elongated member 68 being held in the locked position by reception in aperture opening 28. This type of arrangement is common to both the top and the bottom malelike members 68 and 69. The female socket or apertures 28 in top horizontal piece 7 is defined generally by housing 72. For alignment purposes it may also be wise to include a female guide socket 74 in the very uppermost portion of the door. Thus, as handle 20 is turned in a circular motion, rod 68 is caused to withdraw from female socket 72 thereby permitting panel 2 to be situated in any desired open position. As a result of this locking mechanism, it can be seen that a surmounted track or trackway for sliding the door open is not really contemplated within the scope of this invention although the same could be placed in upper horizontal member 7 as a continuation of female socket 72 transversing the entire length of horizontal piece 7 with means, i.e. a roller or the like, to retain rod 68 during movement. However, when using a top-mounted track, the female socket will also have to be modified by deepening aperture 26 to insure that the shutter does not inadvertently slide to the open position. It should be noted that elongated members 22 and 24 may be either elongated braised or metal rods, which are custom cut to length depending upon the desired height of the bifold doors. It should also be noted that pivot joint 62 is preferably a rivet type connection which provides easy movement of the rod via swivel of the ball crank. Also, knob 20 may be equipped with any conventional nut or washer and itself may be brass braised to the ball crank. Stop nuts may be braised on the rod connecting the handle to the ball crank in order to provide a tighter fit.

FIG. 7 is a block diagram of the fabrication technique used to construct the bifold doors from the raw lumber stage to the finished product. The blocks captions speak for themselves but it should be pointed out that the two nonconcomitant steps of cutting the lumber to the precise size (as further exemplified herein in FIGS. 12–14) and the fabrication of the latch may be done at any time as an independent step, each of which is mutually exclusive. However, when these two items are brought together in the assembly of the parts, (third block) then careful stepwise procedure should be followed to obtain the finished product.

Figure 8:
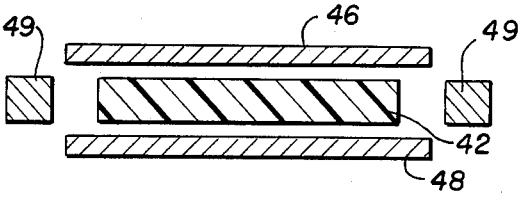
FIG. 8 is an exploded view of the individual parts which are put together in the "assembly parts" of the block diagram of FIG. 7.

FIG. 8 is an exploded view of the individual parts which are put together in the "Assembly Parts" block diagram of FIG. 7. The relative parts are described in regard to FIG. 3.

Figure 9:
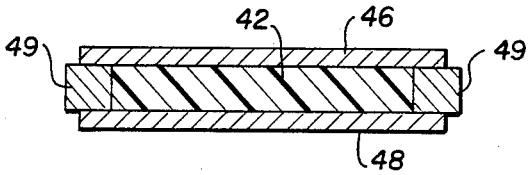
FIG. 9 is a glued together part of FIG. 7.
Figure 10:
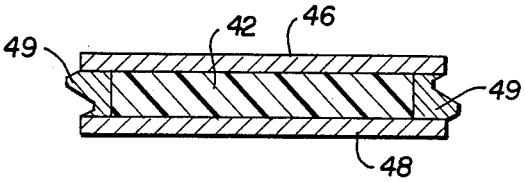
FIG. 10 is the glued together parts of FIG. 8 after being milled.

FIG. 9 shows the parts of FIG. 8 in assembled form after gluing. These parts are now in the pre-milled state. FIG. 10 shows the tongue-in-groove of side parts 49, usually formed by a router as described in FIGS. 20 through 23. In the construction of bifold doors, there will be four such FIG. 10 items, two of which are held together in FIG. 11, by hinges 10 as shown, which is a top elevational view. It is important to note that hinge 10 is situated in tongue-in-groove area of side piece 49. The recessed area for the hinge must be precisely placed within 1/16th of an inch to occasion proper opening and closing of the shutters. And the same results in a complete air tight feature of this invention.

The following has been a description of the shutter per se. It is believed that this shutter has a novel air tight fit without resort to gaskets and the like. And it is believed that the below described unique tools for cutting, routing, gluing, drilling, etc. are responsible for the development of this type of high grade shutter although equivalent tools may be freely substituted therefor.

FIGS. 12 through 28 describe various apparatus which are utilized in the production of these exact fitting shutters. An overall view of the production of these shutters from the initial stage to the finished stage can be described as follows. First, the window or door opening is measured using the inside measurement to the nearest 1/16th of an inch and recorded on a standard measurement form. These measurements are used for all the cutting dimensions in the shop. The panel width is set on a vacuum saw using a micrometric fence and then the panel's skins are cut together, top and bottom to an exact width and/or length. Both the interior and the exterior skins are cut simultaneously by having two sheets of $\frac{1}{4}$, $\frac{3}{8}$, or $\frac{1}{2}$ inch plywood tacked together. This avoids the possibility of having different skins with different lengths or widths as long as one maintains the respective interior and exterior skins for the same bifold door. The inside frames are cut using a 45° miter to insure the exact size. The locking mechanisms are then fabricated utilizing the height dimensions of the inside measurement. The components are then assembled as set forth in the third block of FIG. 7 and in FIGS. 8 through 11. The components are assembled using air tackers and glue guns prior to placing in a pneumatic press wherein the glue sets to form the resultant product of FIG. 9. This insures the flatness of the shutters (no warp or wave in the wood) as hereinafter set forth in the description of the pneumatic press in FIGS. 17 through 19. The edges of the shutters are then milled via a unique router to give the interlocking double tongue-in-groove joint. The hinges are recessed and secured in place by a hinging jig (FIGS. 25 through 27). The resultant shutters are then finished with standard pneumatic sanders, and conventional lacquers, stains, varnishes, finishes, enamel, etc.

FIG. 12 shows the instant novel vacuum-saw 100. This vacuum saw is approximately 16 to 30 feet in length, 5 to 25 feet in width with a 4×8 inch traveler upon which stock which is to be cut will rest and be moved. The use of the vacuum is not for the removal of saw dust, but to hold the inside and outside panels of the shutter in exact placement to the traveler before and during cutting via the saw blade. The basic purpose of the vacuum saw is to provide a traveler 102 which moves on rails 104 over rollers 106 to produce an exact and precise cut. All of these items are disposed on support 101. The rails 104 are completely parallel with one another and therefore the traveler 102 must travel in an exact straight line. The wood therefore must also travel through the saw blade in an exact straight line.

One problem with cutting exact measurements is holding the wood down to traveler table 102. The wood panel (denoted as 110) is held down very firm to traveler 102 by means of the vacuum on the bottom and air pressure on the top, the latter forcing the door down while the former pulls the door down to the traveler table. The requisite vacuum is acquired by vacuum conduits 112 having suction holes 114 in the extremity thereof. The vacuum per se is acquired by means of flexible tubing 116 connected to vacuum source 118 by means of a standard vacuum connection 119. Of course, the saw blade cannot be placed in communication or contact with traveler 102 and the skins (door surface 110) must overlap over the traveler table 102.

In order to provide an exact cut via saw blade 125, a specific micrometric fence is set up for an exact cut. The fence has a crank handle (shown as item 130 of FIG. 14) in communication with a sprocket 132 and chain 134. This common chain with the two idential sprockets keeps both rod revolutions synchronized, the rods being denoted as 136. And the length of these rods from fence to sprocket will determine the exact distance of fence 138 in relation to saw blade 125 to obtain any desired width or length. To facilitate setting of the fence at the desired length, a tape 140 with measurements marked thereon 142 is utilized to set and adjust the microfence. Thus, the width cut is that between the fence 138 and the saw blade 125 and in this manner the direction of cut 150 becomes a one-way sheet, that is the material cannot be drawn back through the blade without binding.

It is also contemplated that a different and discrete vacuum mechanism may be utilized for removal of sawdust from beneath the saw blade 125, but the same is employed in augmentation of the vacuum system 118 et al of this saw which holds down the panel to traveler 102. It can be readily seen that once the plywood sheets are placed one on top of the other and secured in relation to one another, the cut of the top sheet will by necessity be straight and duplicate the cut of the bottom sheet. While the dimensions of the traveler are generally $4\times8\times1\frac{1}{4}$, any feasible dimension can be utilized for passage on rails 104. The distance between parallel rails 104 is unimportant as long as the same are placed on the table and are of sufficient distance so as to guarantee smooth passage of the traveler down the saw support 101 for cutting via blade 125. Rollers 106 are provided more to carry the weight of the traveler and not as a direct or indirect guide means.

FIG. 13 shows a view taken along the line of 13—13 of FIG. 12 showing the attachment of flexible vacuum conduit 16 to traveler 102, the same passing upon rails 104 mounted to support 101. The work product 110 is shown in dotted configuration having atmospheric pressure pressing down on the workpiece while suction is pulled through conduits 112 and openings 114 to aid in holding the workpiece down and in place. The microfence is specifically exemplified in FIG. 14. The tape 140 and the measurement markings 142 can be provided with a viewfinder 155 for showing the exact measurement of the fence 138 from the saw blade. Elongated rods 136 are shown in communication with sprockets 132 and single chain drive 134, all of which communicate to move the fence 138 either closer to or further away from saw blade 125.

FIG. 15 depicts an assembly jig used to formulate and assemble parts in the third block of FIG. 7. The shutter skins may be placed on respective planar surfaces 170 for reception of styrofoam material 42 as shown in FIG. 16. In effect, a laminate sandwich is formed on planar surface 170 and the integral parts may be placed against runner 172 in order to hold the same in position during the assembly of the parts. Any required tools such as a gluing gun or a tacking gun may be maintained in compartments 174 in the center of the assembly jig, the same having a bifurcation or division by means of upright members 178. End pieces 180 are provided so that the tools will not inadvertently fall from the assembly jig and thereby become damaged. FIG. 16 indicates a cross-section view taken along lines 16—16 of FIG. 15 showing end piece 180 and on one side of planar surface 170 the shutter is assembled while on the other side it is awaiting reception of styrofoam material 42. In effect, top surface 46 is simply removed and the styrofoam laid in place and then top surface 46 is placed thereover and tacked in place to assemble the parts. At this point the parts represent those set forth in FIG. 9 which necessitate gluing together.

It is critical that this gluing step be performed in some type of press so as to provide a complete flat surface without ridges or bubbles. If the press is not completely uniform, bubbles will form in the glue vis-a-vis the planar surfaces and an uneven surface for the shutter will result. The most preferred type of press is the pneumatic press as shown in FIGS. 17 through 19 of these drawings. FIG. 17 is a perspective view; FIG. 18 is a cross sectional view taken along lines 18—18 of FIG. 17; and FIG. 19 is an open cross-sectional view of the press of FIG. 17. The pneumatic press is supported from the floor by legs 200. These legs are in communication with frame 202 of the press. The press comprises a top part 204 and a bottom part 206 used to sandwich or press the parts together during gluing. The press is more than merely the clamping of two pieces of wood around a piece of insulating material in the hopes of providing an even distrubution of the glue. Frame members 208 result in an even distribution of weight upon the top planar skin which is to be glued. These frame members are in interconnection with 2×4's 210 running beneath each of frame members 208. The frame is also comprised of top elongated portion 212 and a set of vertical support portions 214. These 2×4's 210 are clamped in place by clamps means 220 to a lower parallel set of 2×4's 222 running perpendicular to support member 202. Thus, in the closed position as shown in FIGS. 17 and 18, the clamp means provide an even pressure distribution over the top surface 204 and on bottom surface 206.

To ensure a complete even distribution of weight on the planar surface, an air bag or bladder having a vinyl or protective cover 230 is utilized. It can be seen from the cross-sectional view of FIG. 18 that workpiece 250 rests on air bladder 230 and acts to evenly distribute weight across the entire planar surface of both top and bottom portions of the panel surface. If desired, a level slab of concrete can be placed upon the bottom support 206 to provide additional support for the air bladder and further guarantee an even distribution of weight upon the planar surfaces. In addition, the underside portion of the top of the press can be provided with a smooth epoxy like surface or plastic resin surface. FIG. 19 shows this pneumatic press in the open position without the object of gluing within its jaws.

FIG. 20 is an elevation view of a router machine or jig useful in milling and forming the tongue-in-groove fit in the side portions of the door panels. The depth of the cut or groove is controlled by the size of the panel and not the depth of the frame stock. The router is therefore set to ensure exact skin panel location during routing. In this way the shutter has the appearance of a solid planar piece of wood when shut and provides better heat insulating properties vis-a-vis those discussed in the aforementioned background prior art section. The milling instrument or router is supported by legs 400 and support frame 402. The workpiece 404 is passed in a single direction 406 past router head 408.

This router head is more clearly depicted in FIG. 21. The router head is placed in communication with table 402 by means of a rod 460 and pivot connected at 410 with an upper portion of the table at 412. As the single door of the bifold doors traverses the router blade, it is placed within the groove 420 to provide a more exact and straight tongue-in-groove cut. As shown in FIG. 29, this system may be modified in order to provide a safety implement to prevent backlash of the panel during routing and to ensure that the operator's fingers do not have to be placed in proximity to the router blade at any time during the routing procedure. The router blade shown in FIG. 21 has a router blade 450 replicating the tongue-in-groove structure, the same being placed on rod 460 and held in place by bolt 470. Rod 460 is connected to a drive means and is revolved at a very high number of revolutions per minute; router blade 450 then moves in a circular fashion to accomplish the routing procedure.

FIG. 22 shows a panel held in place at a position before contact with the router blade while FIG. 23 shows a panel which has traversed the router blade. Various support structures 480 support all of the equipment described in FIGS. 20 through 23.

FIG. 24 is the fragmented perspective view of the two panels held together by hinges. The aperture in the door for penetration of the elongated rod is shown as 500. The panels 502 and 504 are held together by a set of hinges 506 (only one is shown), which is consistent with that of hinge 8 of FIG. 1. Hinge 506 is held in place by four fastening means 508 and it is obvious that when the hinge is closed the tongue-in-groove developed by router 410 (FIG. 20) forms a substantially airtight seal which can not be easily penetrated. However, as a result of the hinge being placed within the elongated tongue-in-groove channel, it is absolutely essential that the same be recessed exactly, i.e. plus or minus 1/16th of an inch. Otherwise the panels simply will not close. This is performed by hinging jig 600 as shown in FIG. 25.

Figure 11:
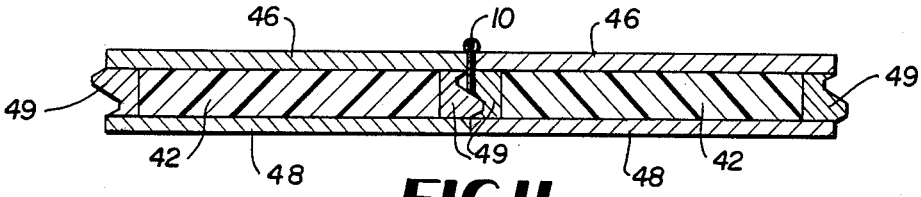
FIG. 11 is a top elevational view of two panels which are hinged together.

The respective doors 502 and 504 are separated by means of an air bladder 510 as shown in FIGS. 26 and 27. The air is supplied to bladder 510 by means of air line 512 (FIG. 25). Hinging jig 600 is comprised of two support pieces 602 in interconnection with a planar surface 604. An opening, 608, is provided in planar surface 604 being receptive to a cover 606. This cover has a cut-out jig portion 610 containing four apertures which are placed precisely over the area of the tongue-in-groove channel wherein the screw holes are to be disposed for securement of the hinges. FIGS. 25 and 26 show cover 610 in an open position while FIG. 27 shows the same in the closed position. It can readily be seen that the air bladder and hinging jig provide an exact location method whereby the hinge area of recess and the drill holes for the hinges can be placed in an exact location. And to effect placement, the cover is left open and a hand held router is placed in hole 608 causing the area of recess to be routed out. After this the cover is closed, a drill penetrates apertures 612 to provide the exact situs of the holes for the screws. In this manner the exact close fitting final product denoted in FIG. 11 is formulated. By following this method of preparation the shutters will be nearly airtight and provide extra insulation qualities.

FIG. 28 is a side view of a safety feature of the vacuum saw. The saw itself is denoted as 800 without having the microfence shown. A fence 805 is shown guiding workpiece 810 in a direction 815 towards a sawblade 813. This device commonly referred to as a finger saving device prevents the workpiece 810 from snapping back at the worker and keeps the same moving in a unitary direction. This guidance system also aids in the exactness of the cut being performed on the workpiece. Surmounted to fence 805 is a support structure 840 having two hold-down arms 855 attached thereto. These arms pivot at 860 such that when the workpiece 810 is slid underneath, a pivot is effected to allow the wood to pass only in a one-way direction and because of the obtuse angle to prevent the same from snapping back at the operator. Tension is maintained on pieces 855 by means of a spring 850 attached to the wood pieces 855 by means of eyelet 870. The spring 850 is attached to the wood support structure 840 via eyelets 845. The force vector 835 operates in a plane parallel to the workpiece in contradistinction to the perpendicular force vector acted upon by arms 855. Tension is maintained in a plane parallel to the workpiece by springs 814 attached to arms 820, via eyelets 812 and the spring 814 being attached to the work support of the saw 800 via eyelets 812. A pivot is provided at 825 so that the curved arms 830 will allow movement of the workpiece in the direction of 815 but prevent movement in any other direction and especially prevent movement opposite that of direction 815. The workpiece contacts the arms at point 835 creating a friction which is released when the workpiece is moved in the direction of 815 by means of pivots 825 and springs 814. The arms 830 are of a curved configuration so as to accomodate different size workpieces. This of course is not necessary for the arms 855 surmounted to support 840 as long as the width of the boards are not undue. For example, a 4×4×6 piece of fence post could be cut on this saw with the same ease as a 1×1×6 piece of furring strip.

FIG. 29 is a side view of a safety feature of the router jig. The support for the router 900 has passing thereover a workpiece 905 in the direction of the router 910. Arms 916 and 950 prevent movement of the material after contact has been made with the router blade. In a plane vector perpendicular to the workpiece, a support 915 is provided in communication with hold-down arms 916. A pivot 917 is provided so that the arms 916 move in the direction of the workpiece, thus permitting the same to be passed in a direction through the router but denying, in coordination with arms 950, the backlash of the workpiece in a direction opposite that of 910. Arms 916 are held to the support 915 by means of spring 920 and eyelets 921 and 918. Wheels 920, while preferred in this invention are not absolutely necessary. They are held to arms 916 by casters and axles 923. In a plane parallel to that of the router blade, arms 950 prevent the movement of the workpiece in any direction but 910. These arms are pivoted at 957 so that the workpiece may transverse the router. Arms 950 are held to table 900 by means of eyelets 958 and 955 in communication with spring 956. Both the devices of FIGS. 28 and 29 will act to prevent injury to the operator and to provide a more efficient and exact cut on the wood pieces. Again, as in FIG. 28, the router table may be adapted to any size of material from a 4×4×8 to a 1×1×6.

While this invention has been described via FIGS. 1 through 29, it is contemplated that all respective equivalents may be substituted and that the shutters need not be made by the preferred method of manufacture of FIGS. 12 through 29. However, the latter is the preferred method and is believed the easiest mode of constructing these shutters.

What I claim as my invention is the following:

1. An insulated shutter assembly comprised of (1) a frame having upper and lower horizontal frame members of substantially equal length and having apertures therein, said upper and lower horizontal frame members being interconnected by two vertical frame members of substantially equal length and (2) two tightly-fitting insulation-filled bifold doors supported within said frame wherein each bifold door is comprised of:

a. two insulation-filled panels one of which is an exterior panel which is hinged to one of the vertical frame members and the other of which is an interior panel, said insulation filled panels having vertical edges normal to the horizontal frame members when the shutter is closed, the vertical edges of said panels having both a tongue and a groove along the length thereof, the tongue of each panel's vertical edge that is adjacent the other panel interfitting with the groove of the adjacent panel's vertical edge when the bifold door is closed to form a double tongue and groove airtight closure;

b. double-leaf hinges connecting the adjacent panels to each other, one leaf of each panel-connecting hinge extending into and being recessed in the groove of the vertical edge of one panel and not extending into the tongue thereof, and the other leaf of said panel-connecting hinge extending into and being recessed in the tongue of the vertical edge of the other adjacent panel and not extending into the groove thereof whereby two tongue and groove channels are formed by the interface of the adjacent vertical edges of the panels when the bifold doors are closed, one of said channels being uninterrupted and airtight and the other channel being interrupted only at the loci where the hinges are located;

said insulation-filled bifold doors, when the shutter is closed, contacting each other along interior vertical panel edges of their respective interior panels; the tongue of each panel's interior vertical edge being in contact with the groove of the other panel's interior vertical edge and interfitting therewith to form a double tongue and groove airtight closure comprised of two uninterrupted tongue and groove channels formed by the interface of the adjacent interior vertical edges;

said insulation-filled bifold doors being supported within said frame by double-leaf hinges connecting each of the two exterior panels to a different one of the two vertical frame members, said vertical frame members each having an interior vertical edge running the length of the portion thereof within the opening formed by the vertical and upper and lower horizontal frame members, said interior vertical edge comprising a tongue and a groove, which tongue and groove interfits with the tongue and groove of the exterior vertical edge of the exterior panel of the bifold door connected to the vertical frame member to form two tongue and groove channels; said leaves of the double-leaf hinges connecting said panels to the vertical frame members extending into one tongue and groove channel and not the other, whereby one of the tongue and groove channels formed by the exposed tongue and groove of the interior vertical edge of the vertical member and the tongue and groove of the exterior vertical edge of the exterior panel is uninterrupted and airtight and the other of the tongue and groove channels formed by the exposed tongue and groove of the interior vertical edge of the vertical member and the tongue and groove of the exterior vertical edge of the exterior panel is interrupted only at the loci where the hinges are located; and each of said bifold doors having a means of locking same in a closed position comprising two elongated rod-like members receptive at one extreme for penetration into said apertures in said upper and lower horizontal frame members and connecting at the other extreme to movement means, wherein when said movement means is actuated in one direction the rod-like members concomitantly retreat from said apertures in said elongated top and bottom frame members and when said movement means is actuated in the opposite direction, said rod-like members concomitantly penetrate said apertures in said elongated top and bottom horizontal frame members.

* * * * *